US010413780B2

(12) United States Patent
Madson et al.

(10) Patent No.: US 10,413,780 B2
(45) Date of Patent: Sep. 17, 2019

(54) GOLF BALL DIMPLE SHAPE

(71) Applicant: Acushnet Company, Fairhaven, MA (US)

(72) Inventors: Michael R. Madson, Easton, MA (US); Nicholas M. Nardacci, Barrington, RI (US); Chris Hixenbaugh, Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 15/880,652

(22) Filed: Jan. 26, 2018

(65) Prior Publication Data

US 2018/0147450 A1 May 31, 2018

Related U.S. Application Data

(63) Continuation of application No. 14/983,495, filed on Dec. 29, 2015, now Pat. No. 9,878,212.

(51) Int. Cl.

| | |
|---|---|
| ***A63B 37/00*** | (2006.01) |
| ***A63B 37/14*** | (2006.01) |
| ***A63B 45/00*** | (2006.01) |

(52) U.S. Cl.

CPC ..... *A63B 37/0008* (2013.01); *A63B 37/0004* (2013.01); *A63B 37/0007* (2013.01); *A63B 37/008* (2013.01); *A63B 37/0009* (2013.01); *A63B 37/0012* (2013.01); *A63B 37/0016* (2013.01); *A63B 37/0019* (2013.01); *A63B 45/00* (2013.01)

(58) Field of Classification Search

CPC ..... A63B 37/0008; A63B 37/0012; A63B 37/008; A63B 37/0019; A63B 37/0016; A63B 37/0009; A63B 37/0007; A63B 37/0004

See application file for complete search history.

(56) References Cited

U.S. PATENT DOCUMENTS

| | | | | |
|---|---|---|---|---|
| 4,284,276 | A * | 8/1981 | Worst | A63B 37/0004 40/327 |
| 5,536,013 | A * | 7/1996 | Pocklington | A63B 37/0004 473/384 |
| 5,547,197 | A | 8/1996 | Pocklington | |
| 5,653,648 | A * | 8/1997 | Thurman | A63B 37/0004 473/384 |
| 5,879,245 | A | 3/1999 | Hwang | |
| 5,890,975 | A * | 4/1999 | Stiefel | A63B 37/0004 473/384 |
| 6,475,105 | B1 * | 11/2002 | Murphy | A63B 37/0004 473/378 |
| 2006/0223654 | A1 * | 10/2006 | Kennedy, III | A63B 37/0004 473/371 |

(Continued)

*Primary Examiner* — John E Simms, Jr.

(74) *Attorney, Agent, or Firm* — Mandi B. Milbank

(57) ABSTRACT

The present invention is directed to golf balls having improved aesthetics and desirable aerodynamic properties due, at least in part, to the novel shape of the dimples on the surface thereof. In particular, the present invention is directed to a golf ball that includes at least a portion of its dimples having a shape obtained from the intersection of a toroid and a sphere. The resulting curve of intersection represents the dimple perimeter and the intersecting portion of the surface of the toroid represents the dimple surface shape.

1 Claim, 14 Drawing Sheets

(56) References Cited

U.S. PATENT DOCUMENTS

| | | | | |
|---|---|---|---|---|
| 2007/0259738 | A1* | 11/2007 | Sato | A63B 37/0004 473/378 |
| 2011/0111887 | A1 | 5/2011 | Sullivan | |
| 2011/0300971 | A1 | 12/2011 | Nakagawa | |
| 2013/0005510 | A1 | 1/2013 | Kim | |
| 2017/0182365 | A1 | 6/2017 | Madson | |

* cited by examiner

GOLF BALL DIMPLE SHAPE

CROSS-REFERENCE TO RELATED APPLICATIONS

This application is a continuation of U.S. patent application Ser. No. 14/983,495, filed on Dec. 29, 2015, the entire disclosure of which is hereby incorporated herein by reference.

FIELD OF THE INVENTION

The present invention relates to golf ball dimples having a novel shape obtained from the intersection of a toroid and a sphere.

BACKGROUND OF THE INVENTION

Dimples on the outer surface of golf balls are known to have a significant effect on the aerodynamic forces acting on the ball during flight. For example, the dimples on a golf ball create a turbulent boundary layer around the ball. The turbulence energizes the boundary layer and helps it stay attached further around the ball to reduce the area of the wake. This greatly increases the pressure behind the ball and substantially reduces the drag. Dimples also contribute to the overall aesthetic appearance of the ball. Based on the role that dimples play in aesthetics and aerodynamic characteristics of golf balls, golf ball manufacturers continually seek to develop novel dimple patterns, sizes, plan shapes, volumes, cross-sections, etc. Thus, the present invention is directed to a golf ball having uniquely shaped dimples that provide the ball with enhanced aesthetics and unique aerodynamic properties.

SUMMARY OF THE INVENTION

The present invention is directed to a golf ball having a spherical surface and comprising a plurality of recessed dimples on the spherical surface, at least a portion of which, for example, about 50 percent or more, or about 80 percent or more, have a perimeter defined by a curve of intersection resulting from the intersection of a toroid with a sphere and a surface shape defined by the portion of the toroidal outer surface that intersects with the sphere.

In a particular embodiment, the toroid is a rectangular toroid. In another particular embodiment, the toroid is an elliptical toroid. In another particular embodiment, the toroid is a circular toroid. In another particular embodiment, the toroid is a rectangular twisted toroid.

BRIEF DESCRIPTION OF THE DRAWINGS

In the accompanying drawings, which form a part of the specification and are to be read in conjunction therewith, and which are given by way of illustration only, and thus are not meant to limit the present invention.

DETAILED DESCRIPTION

The present invention is directed to golf balls having improved aesthetics and desirable aerodynamic properties due, at least in part, to the use of dimples having a novel shape obtained from the intersection of a toroid and a spherical body, the spherical body representing the golf ball. The resulting curve of intersection represents the dimple perimeter. The portion of the toroidal outer surface that intersects with the sphere represents the dimple surface shape. The dimple volume is the space enclosed within the dimple surface shape and the portion of the spherical surface within the dimple perimeter.

Figure 1:
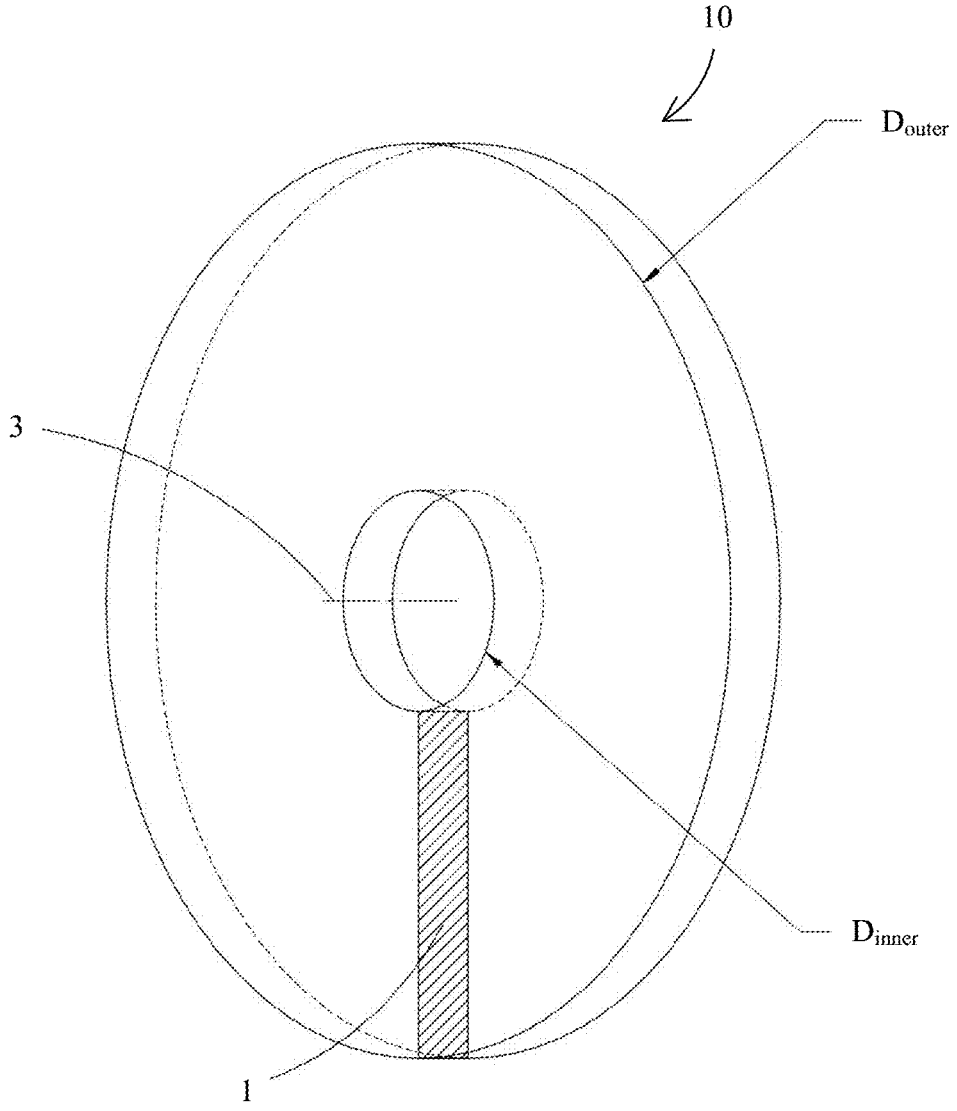
FIG. 1 illustrates a rectangular toroid according to an embodiment of the present invention.
Figure 2:
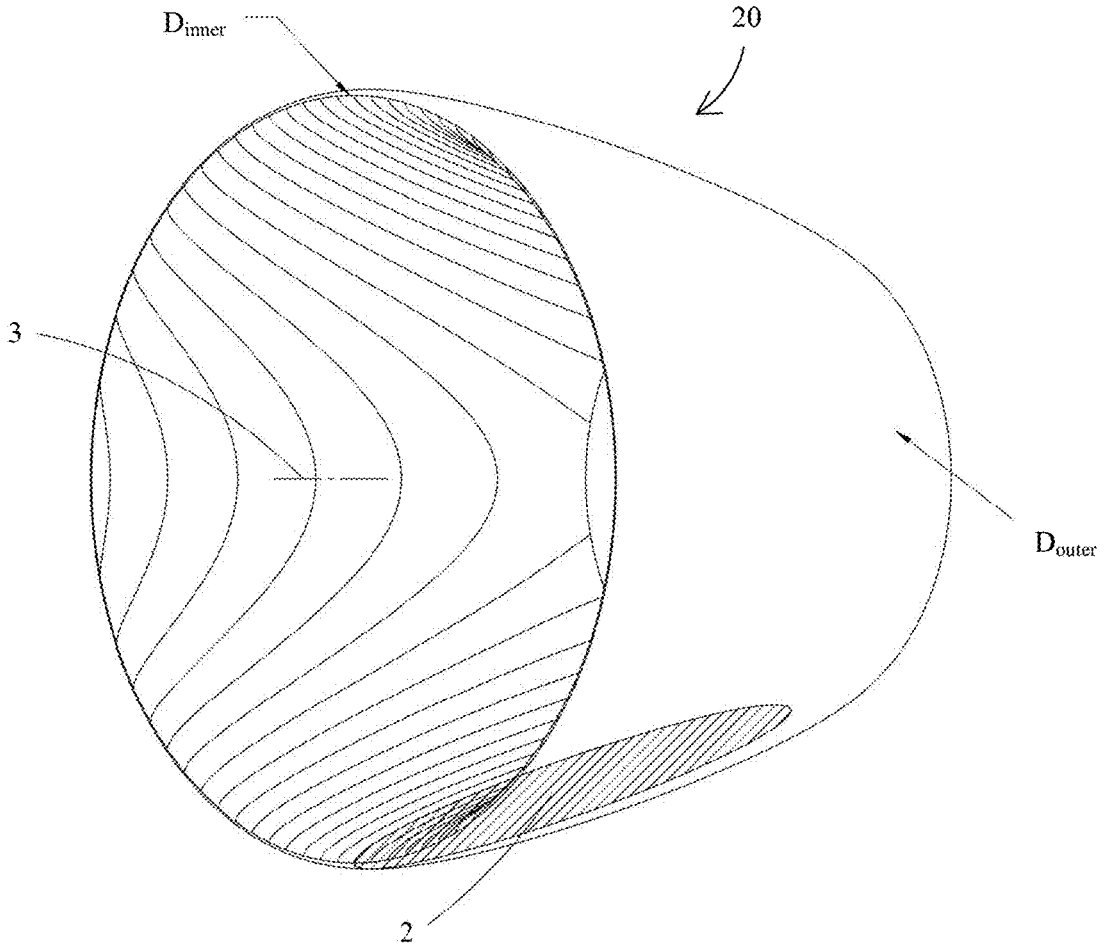
FIG. 2 illustrates an elliptical toroid according to an embodiment of the present invention.
Figure 3:
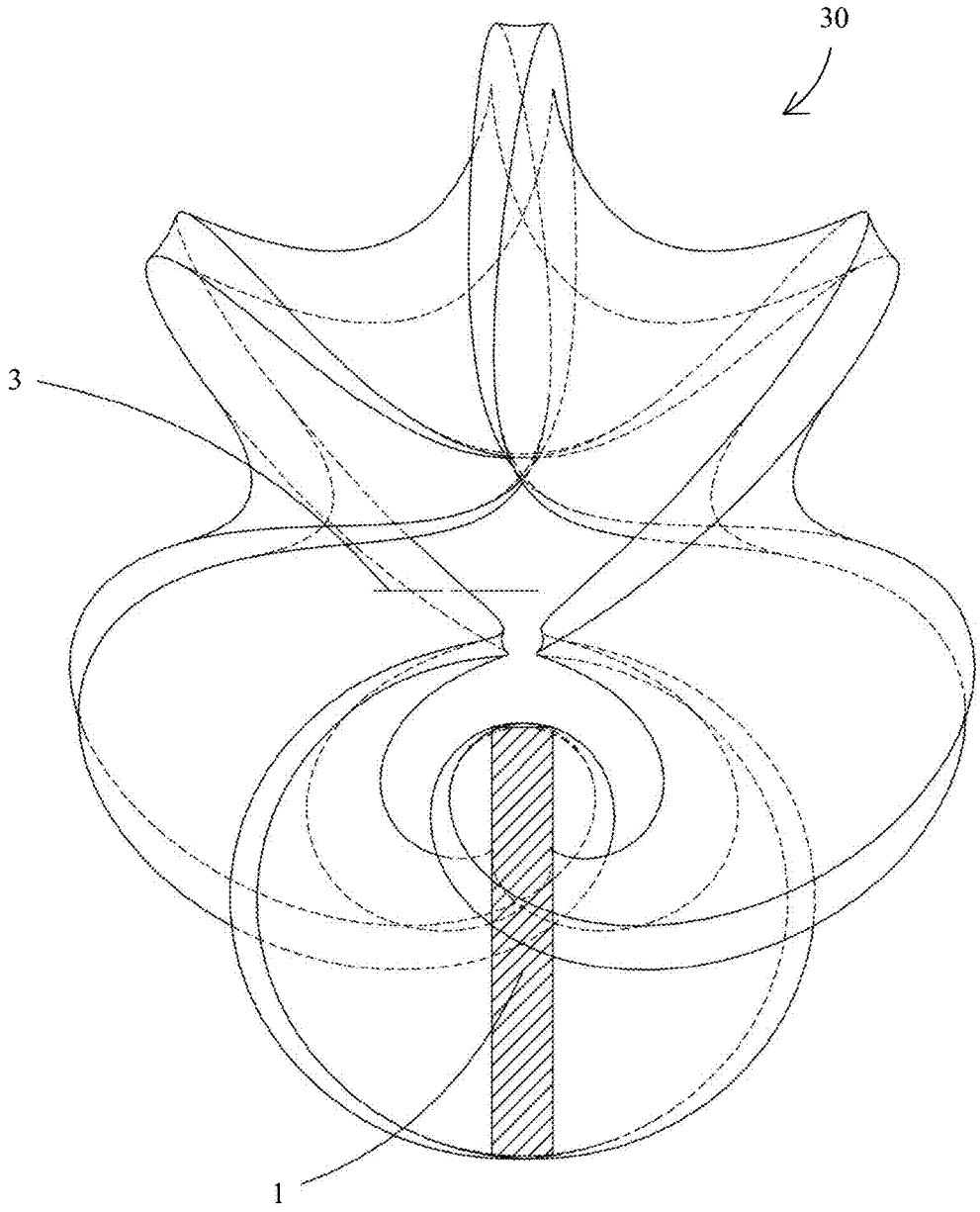
FIG. 3 illustrates a rectangular twisted toroid according to an embodiment of the present invention.

A toroid is a solid formed by revolving a closed plane geometric figure in three-dimensional space about an axis which is external to and does not intersect the closed plane geometric figure. For example, FIG. 1 illustrates a rectangular toroid 10 formed by revolving a rectangle 1 about a rotational axis 3. FIG. 2 illustrates an elliptical toroid 20 formed by revolving an ellipse 2 about a rotational axis 3. The geometric figure is optionally twisted as it is revolved about the axis, resulting in a twisted toroid. For example, FIG. 3 illustrates a rectangular twisted toroid 30 formed by twisting the rectangle 1 as it is revolved about a rotational axis 3. In the embodiment shown in FIG. 3, the rectangle 1 is twisted six times as it is revolved about the rotational axis 3.

As shown in FIGS. 1 and 2, toroids have a defining outer diameter, $D_{outer}$, a defining inner diameter, $D_{inner}$, and a defining average diameter, $D_{ave}$, wherein $$D_{ave} = \frac{D_{outer} + D_{inner}}{2}.$$

In forming dimples of the present invention, the average diameter of the toroid, $D_{ave}$, is related to the diameter of the golf ball, $D_{ball}$, such that the ratio of $D_{ave}$ to $D_{ball}$ is defined as $$0.5 \leq \frac{D_{ave}}{D_{ball}} \leq 5.$$

For purposes of the present invention, the spherical surface of the golf ball has a diameter, $D_{ball}$, of from 1.62 inches to 1.72 inches.

Figure 4A:
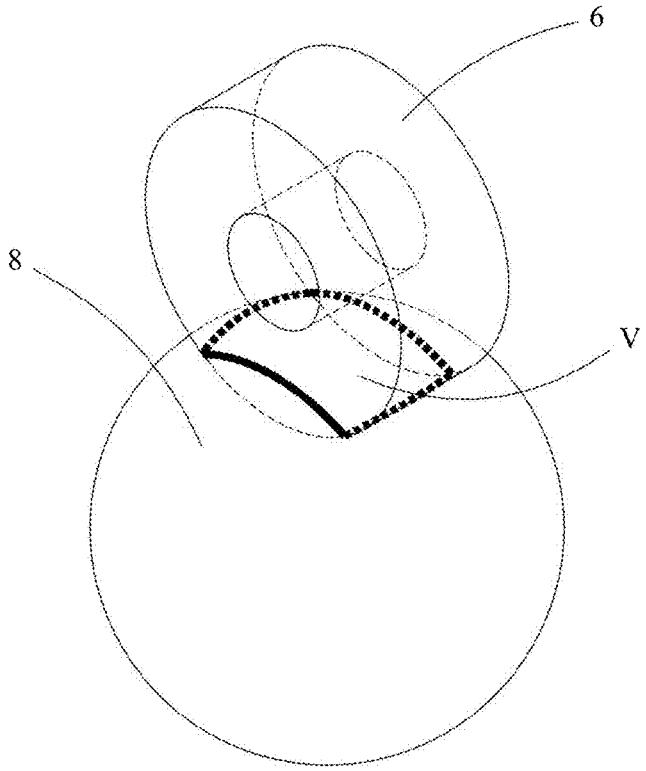
FIG. 4A illustrates an intersection of two solids according to an embodiment of the present invention.
Figure 4B:
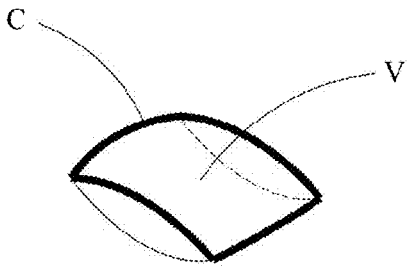
FIG. 4B illustrates a common volume resulting from an intersection of two solids according to an embodiment of the present invention.

Referring now to FIGS. 4A and 4B, the intersection of a rectangular toroid 6 and a sphere 8 results in a common volume V defined by two bounding surfaces $S_1$ and $S_2$. Bounding surface $S_1$ represents the intersecting portion of the spherical outer surface, and corresponds to the phantom surface of the golf ball in accordance with the present invention. Bounding surface $S_2$ represents the intersecting portion of the toroidal outer surface, and corresponds to the dimple surface shape in accordance with the present invention. Bounding surfaces $S_1$ and $S_2$ meet at the curve of intersection C, which is the curve along which the outer surface of the toroid 6 and the outer surface of the sphere 8 share common points. The curve of intersection C corresponds to the dimple perimeter in accordance with the present invention. In a particular embodiment, the curve of intersection defining the dimple perimeter is a continuous curve, such as that illustrated in FIG. 6C discussed further below. In another particular embodiment, the curve of intersection defining the dimple perimeter is a discontinuous curve, such as that illustrated in FIGS. 5C and 7C discussed further below.

Figure 8:
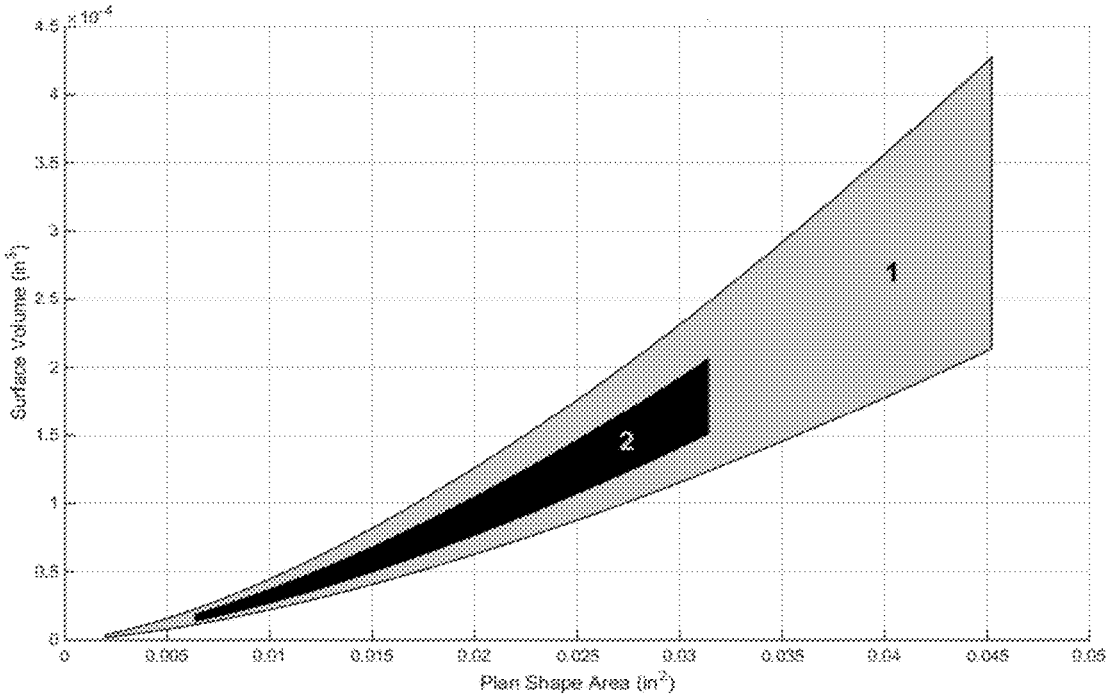
FIG. 8 is a graphical representation of dimple surface volumes for golf balls according to an embodiment of the invention.

The common volume resulting from the intersection of the two solids, i.e., the space between the two bounding surfaces $S_1$ and $S_2$, represents the dimple surface volume in accordance with the present invention. FIG. 8 is a graphical representation of dimple surface volumes contemplated over a range of plan shape areas for dimples produced in accordance with the present invention. The plan shape area of dimples of the present invention is based on a planar view of the dimple plan shape such that the viewing direction is normal to an axis connecting the center of the ball to the centroid of the dimple volume. In a particular embodiment, dimples produced in accordance with the present invention have a plan shape area and dimple surface volume within a range having a lower limit and an upper limit selected from the values within shaded area 1 of FIG. 8. In another embodiment, dimples produced in accordance with the present invention have a plan shape area and dimple surface volume within a range having a lower limit and an upper limit selected from the values within shaded area 2 of FIG. 8.

Figure 5A:
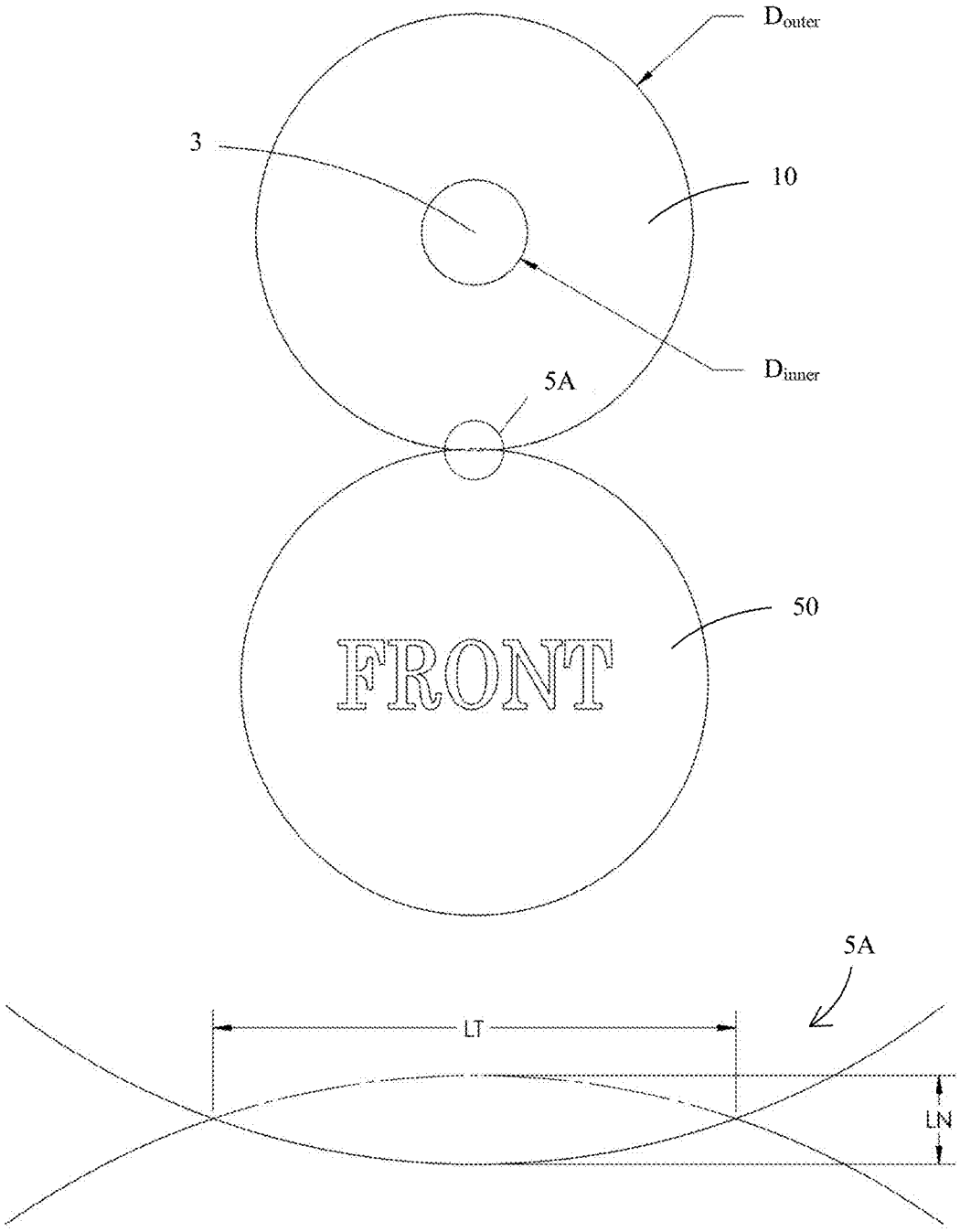
FIG. 5A illustrates a front view of a rectangular toroid intersecting with the spherical surface of a golf ball, according to an embodiment of the present invention, and includes an enlarged view of the intersecting portion.
Figure 5B:
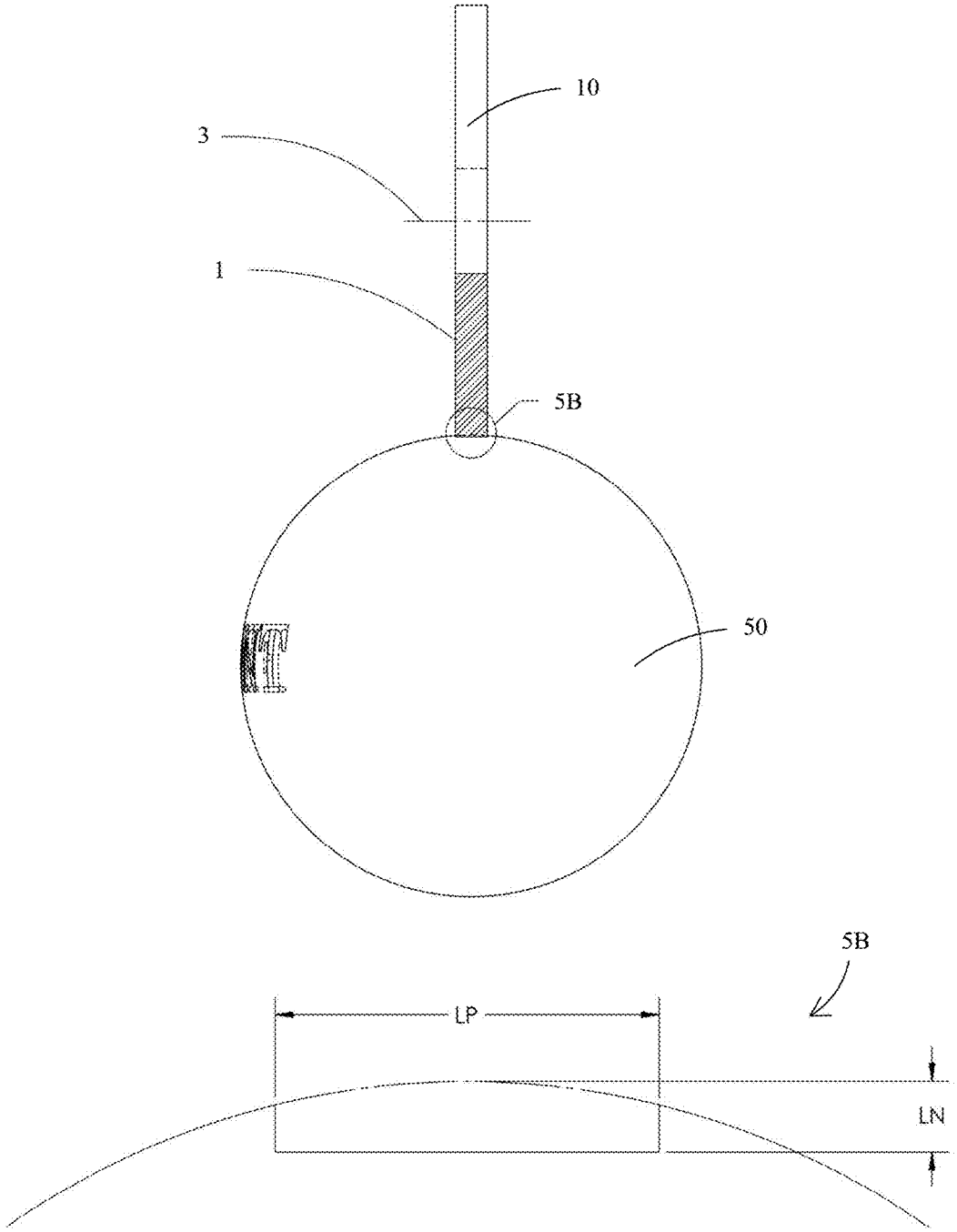
FIG. 5B illustrates a side view of a rectangular toroid intersecting with the spherical surface of a golf ball, according to an embodiment of the present invention, and includes an enlarged view of the intersecting portion.
Figure 5C:
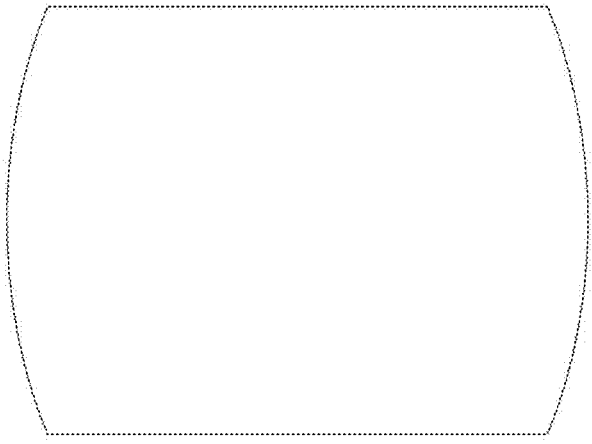
FIG. 5C illustrates a top view of a dimple according to an embodiment of the invention.
Figure 5D:
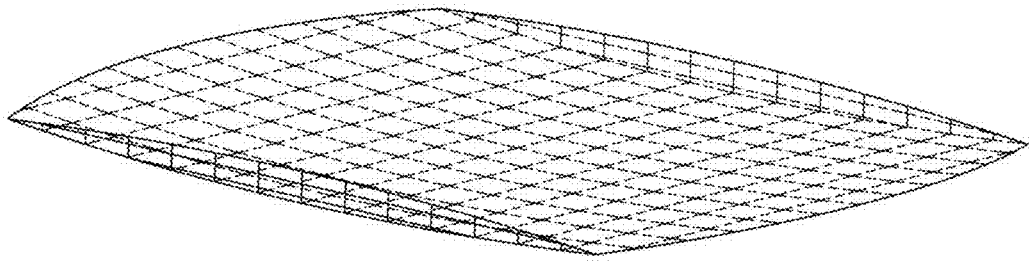
FIG. 5D illustrates a perspective view of a dimple surface according to an embodiment of the invention.

FIGS. 5A-7D illustrate a method for forming golf ball dimples having a shape, particularly a perimeter and a surface shape, obtained from the intersection of a toroid with a sphere, and the golf ball dimples formed from such method. FIGS. 5A and 5B are two-dimensional cross-section views of the rectangular toroid 10 of FIG. 1 intersecting with a sphere representing a golf ball 50. FIG. 5A shows the front view 5A of the intersection of the two solids, including an enlarged view of the intersection, and FIG. 5B shows the side view 5B of the intersection of the two solids, including an enlarged view of the intersection. FIG. 5C is a top view of the curve of intersection resulting from the toroid/sphere intersection shown in FIGS. 5A and 5B. The curve of intersection shown in FIG. 5C is discontinuous and defines the dimple perimeter. FIG. 5D is a perspective view of the portion of the toroidal outer surface that intersects with the golf ball in the toroid/sphere intersection shown in FIGS. 5A and 5B, and defines the dimple surface shape. In FIGS. 5A-5D, the outer diameter of the toroid, $D_{outer}$, is related to the diameter of the sphere, $D_{ball}$, such that the ratio of $D_{outer}$:$D_{ball}$=0.94.

Figure 6A:
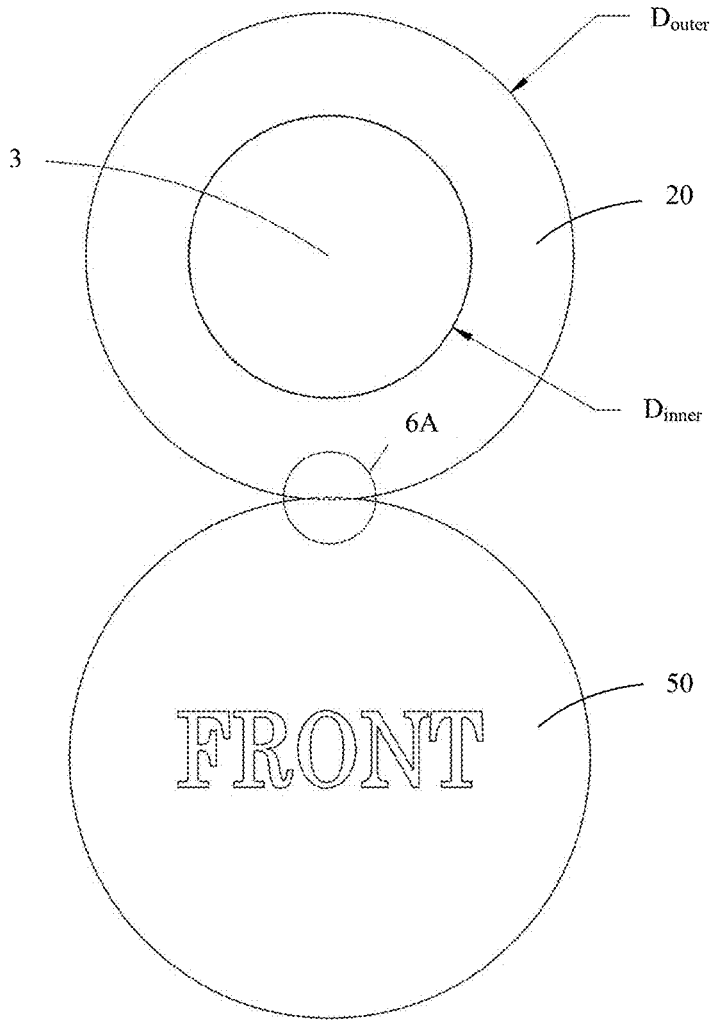
FIG. 6A illustrates a front view of an elliptical toroid intersecting with the spherical surface of a golf ball, according to an embodiment of the present invention, and includes an enlarged view of the intersecting portion.
Figure 6A:
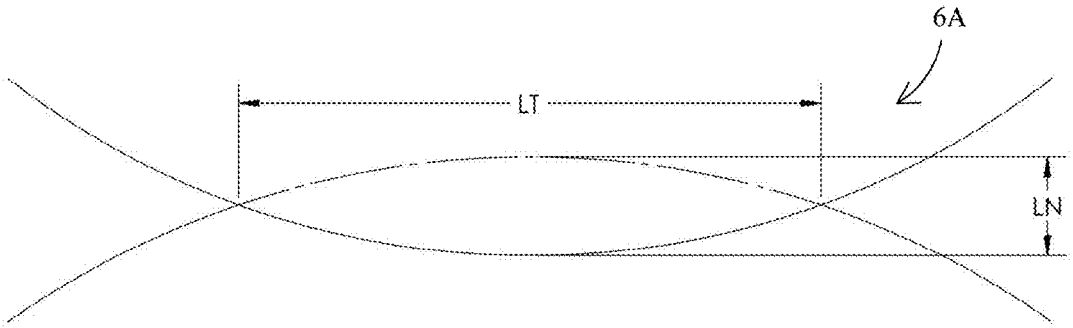
Figure 6B:
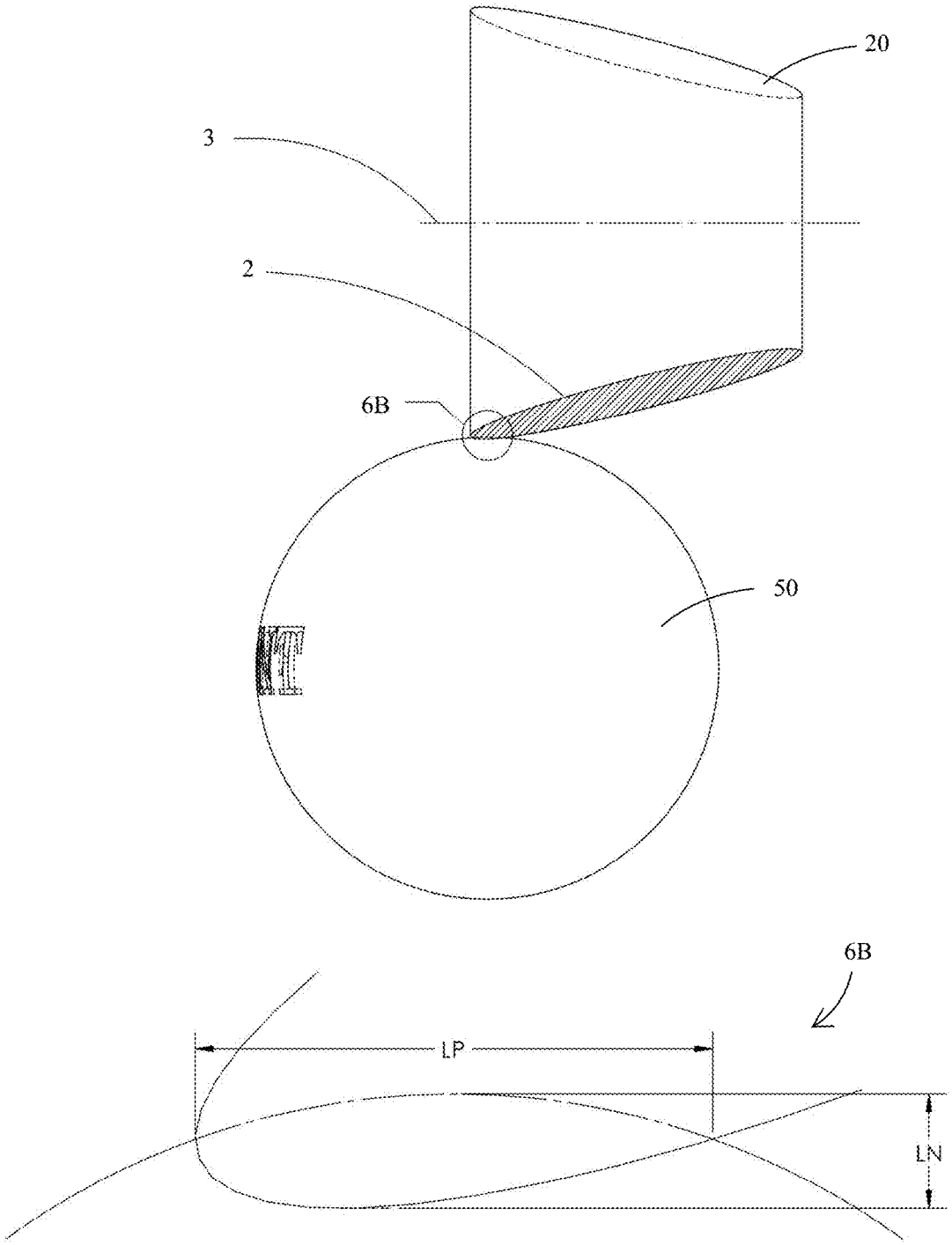
FIG. 6B illustrates a side view of an elliptical toroid intersecting with the spherical surface of a golf ball, according to an embodiment of the present invention, and includes an enlarged view of the intersecting portion.
Figure 6C:
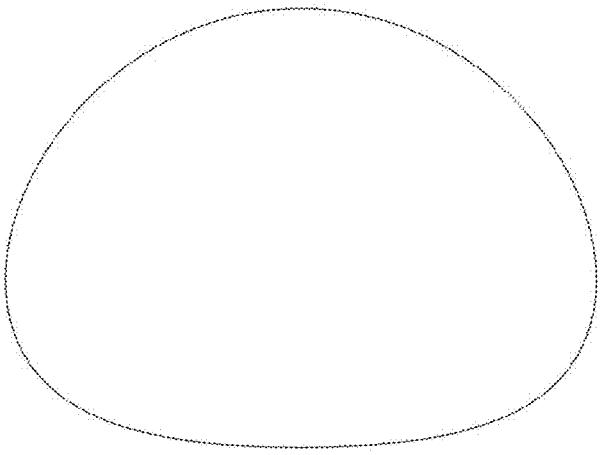
FIG. 6C illustrates a top view of a dimple according to an embodiment of the invention.
Figure 6D:
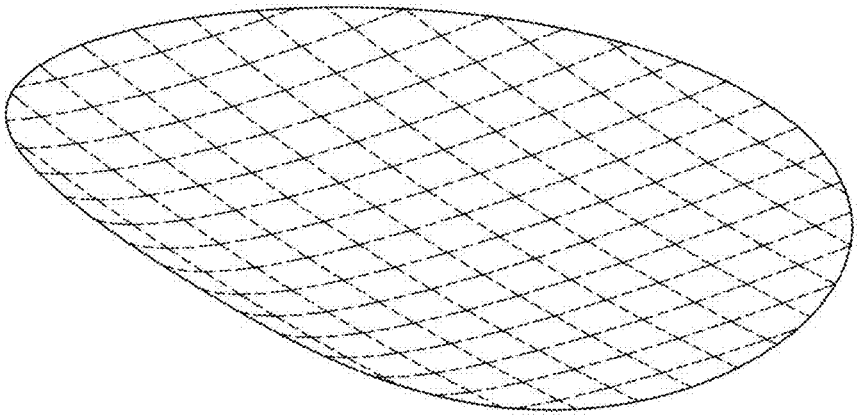
FIG. 6D illustrates a perspective view of a dimple surface according to an embodiment of the invention.

FIGS. 6A and 6B are two-dimensional cross-section views of the elliptical toroid 20 of FIG. 2 intersecting with a sphere representing a golf ball 50. FIG. 6A shows the front view 6A of the intersection of the two solids, including an enlarged view of the intersection, and FIG. 6B shows the side view 6B of the intersection of the two solids, including an enlarged view of the intersection. FIG. 6C is a top view of the curve of intersection resulting from the toroid/sphere intersection shown in FIGS. 6A and 6B. The curve of intersection shown in FIG. 6C is continuous and defines the dimple perimeter. FIG. 6D is a perspective view of the portion of the toroidal outer surface that intersects with the golf ball in the toroid/sphere intersection shown in FIGS. 6A and 6B, and defines the dimple surface shape In FIGS. 6A-6D, the outer diameter of the toroid, $D_{outer}$, is related to the diameter of the sphere, $D_{ball}$, such that the ratio of $D_{outer}$:$D_{ball}$=0.94.

Figure 7A:
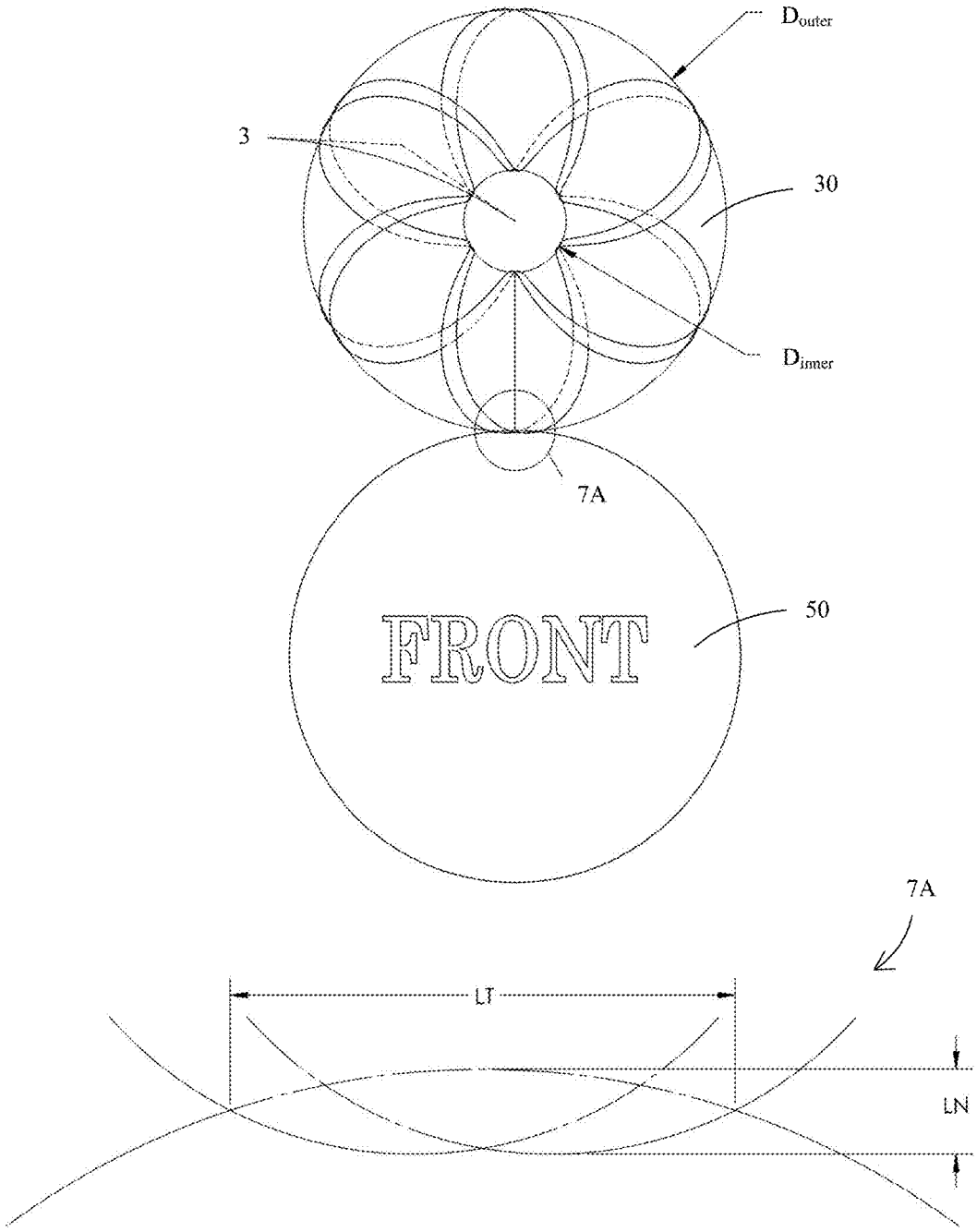
FIG. 7A illustrates a front view of a rectangular twisted toroid intersecting with the spherical surface of a golf ball, according to an embodiment of the present invention, and includes an enlarged view of the intersecting portion.
Figure 7B:
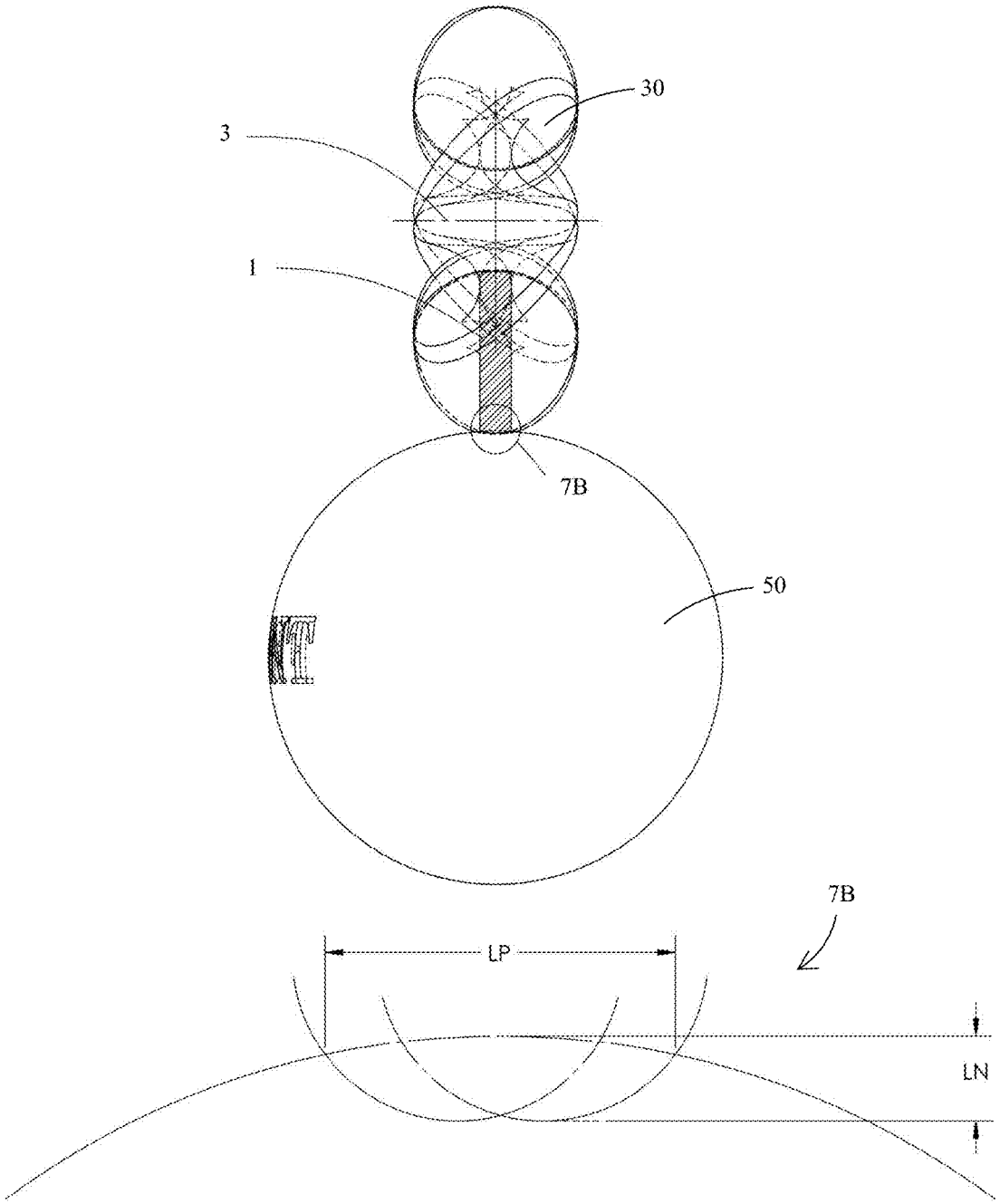
FIG. 7B illustrates a side view of a rectangular twisted toroid intersecting with the spherical surface of a golf ball, according to an embodiment of the present invention, and includes an enlarged view of the intersecting portion.
Figure 7C:
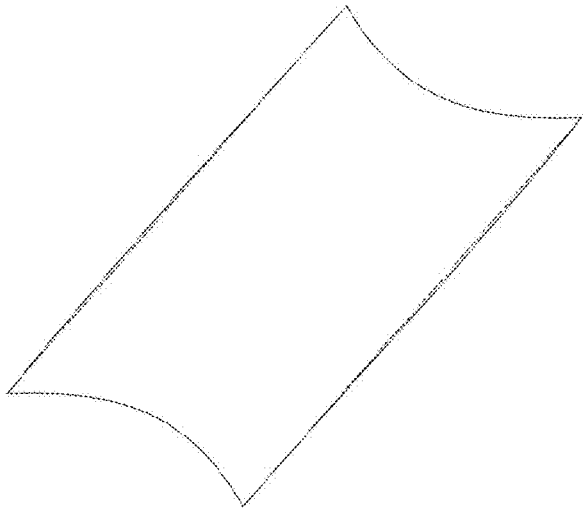
FIG. 7C illustrates a top view of a dimple according to an embodiment of the invention.
Figure 7D:
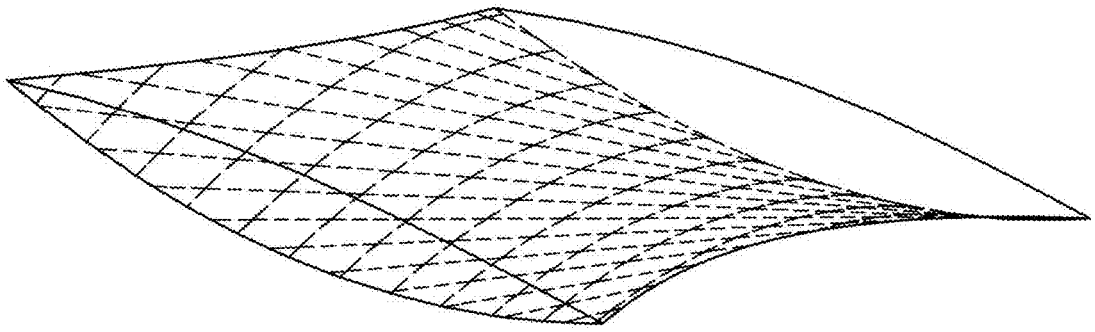
FIG. 7D illustrates a perspective view of a dimple surface according to an embodiment of the invention.

FIGS. 7A and 7B are two-dimensional cross-section views of the rectangular twisted toroid 30 of FIG. 3 intersecting with a sphere representing a golf ball 50. FIG. 7A shows the front view 7A of the intersection of the two solids, including an enlarged view of the intersection, and FIG. 7B shows the side view 7B of the intersection of the two solids, including an enlarged view of the intersection. FIG. 7C is a top view of the curve of intersection resulting from the toroid/sphere intersection shown in FIGS. 7A and 7B. The curve of intersection shown in FIG. 7C is discontinuous and defines the dimple perimeter. FIG. 7D is a perspective view of the portion of the toroidal outer surface that intersects with the golf ball in the toroid/sphere intersection shown in FIGS. 7A and 7B, and defines the dimple surface shape. In FIGS. 7A-7D, the outer diameter of the toroid, $D_{outer}$, is related to the diameter of the sphere, $D_{ball}$, such that the ratio of $D_{outer}$:$D_{ball}$=0.94.

The intersection of a toroid with a spherical body representing a golf ball to form a dimple shape on the golf ball is limited by three defining dimensions: the maximum normal interference length, $L_N$, the maximum toroidal interference length, $L_T$, and the maximum profile interference length, $L_P$.

As shown in FIGS. 5A, 5B, 6A, 6B, 7A, and 7B, the maximum normal interference length, $L_N$, is the distance between the point along the portion of the toroidal outer surface that intersects with the sphere and which lies on an axis connecting the centroid of the toroid to the centroid of the sphere to the point along the portion of the spherical outer surface that intersects with the toroid and which lies on the axis. In a particular embodiment, the maximum normal interference length, $L_N$, is 0.002 inches or 0.003 inches or 0.005 inches or 0.006 inches or 0.010 inches or 0.015 inches or 0.017 inches or 0.020 inches, or is within a range having a lower limit and an upper limit selected from these values.

As shown in FIGS. 5A, 6A, and 7A, the maximum toroidal interference length, $L_T$, is the distance between the two points of intersection of the toroidal outer surface and the spherical outer surface in the plane containing $D_{outer}$. In a particular embodiment, the maximum toroidal interference length, $L_T$, is from 0.050 inches to 0.400 inches.

As shown in FIGS. 5B, 6B, and 7B, the maximum profile interference length, $L_P$, is the distance between the two points of intersection of the toroidal outer surface and the spherical outer surface in the plane containing the rotational axis of the toroid and the centroid of the sphere. In a particular embodiment, the maximum profile interference length, $L_P$, is from 0.050 inches to 0.400 inches.

In a particular embodiment, the maximum toroidal interference length, $L_T$, does not equal the maximum profile interference length, $L_P$.

The intersection of the toroid and the sphere to define a dimple should result in a dimple volume wherein there is no undercut, meaning that the widest part of the dimple volume in any orientation coincides with the spherical outer surface.

Dimple Patterns & Packing

In a particular embodiment, each dimple having a perimeter and a surface shape defined in accordance with the present invention is part of an overall dimple pattern that maximizes surface coverage uniformity and packing efficiency. Thus, in one embodiment, the dimple pattern provides for overall dimple coverage of 80% or greater. In another embodiment, the dimple pattern provides for overall dimple coverage of 85% or greater. In another embodiment, the dimple pattern provides for overall dimple coverage of 90% or greater. In another embodiment, the dimple pattern provides for overall dimple coverage of 92% or greater.

While dimples having a perimeter and a surface shape defined in accordance with the present invention may be used for at least a portion of the dimples on a golf ball, it is not necessary that such dimple perimeter and surface shapes be used on every dimple of a golf ball. In general, it is preferred that a sufficient number of dimples on the ball have a perimeter and a surface shape defined according to the present invention so that the aerodynamic characteristics of the ball may be altered and the unique aesthetics realized. Thus, in one embodiment, 30% or greater of the dimples on a golf ball include a perimeter and a surface shape according to the present invention. In another embodiment, 50% or greater of the dimples on a golf ball include a perimeter and a surface shape according to the present invention. In another embodiment, 70% or greater of the dimples on a golf ball include a perimeter and a surface shape according to the present invention. In another embodiment, 90% or greater of the dimples on a golf ball include a perimeter and a surface shape according to the present invention. In another embodiment, 95% or greater of the dimples on a golf ball include a perimeter and a surface shape according to the present invention. In another embodiment, 99% or greater of the dimples on a golf ball include a perimeter and a surface shape according to the present invention. In another embodiment, 100% of the dimples on a golf ball include a perimeter and a surface shape according to the present invention.

While the present invention is not limited by any particular dimple pattern, in one embodiment, dimples having a perimeter and a surface shape defined according to the present invention are arranged along parting lines or equatorial lines, in proximity to the poles, or along the outlines of a geodesic or polyhedron pattern, and dimples that do not have a perimeter and a surface shape defined according to the present invention occupy the remaining spaces. In another embodiment, dimples that do not have a perimeter and a surface shape defined according to the present invention are arranged along parting lines or equatorial lines, in proximity to the poles, or along the outlines of a geodesic or polyhedron pattern, and dimples that have a perimeter and a surface shape defined according to the present invention occupy the remaining spaces. Suitable dimple patterns include, but are not limited to, polyhedron-based patterns (e.g., icosahedron, octahedron, dodecahedron, tetrahedron, icosidodecahedron, cuboctahedron, and triangular dipyramid), phyllotaxis-based patterns, spherical tiling patterns, and random arrangements.

Golf Ball Construction

The dimples of the present invention may be used with practically any type of ball construction. For instance, the golf ball may have a two-piece design, a double cover, or veneer cover construction depending on the type of performance desired of the ball. Other suitable golf ball constructions include solid, wound, liquid-filled, and/or dual cores, and multiple intermediate layers.

Different materials may be used in the construction of the golf balls made with the present invention. For example, the cover of the ball may be made of a thermoset or thermoplastic, a castable or non-castable polyurethane and polyurea, an ionomer resin, balata, or any other suitable cover material known to those skilled in the art. Conventional and non-conventional materials may be used for forming core and intermediate layers of the ball including polybutadiene and other rubber-based core formulations, ionomer resins, highly neutralized polymers, and the like.

When numerical lower limits and numerical upper limits are set forth herein, it is contemplated that any combination of these values may be used.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball having a generally spherical surface and comprising a plurality of dimples on the spherical surface, wherein at least a portion of the dimples have a perimeter defined by a curve of intersection resulting from the intersection of a toroid with the spherical surface of the golf ball and a surface shape defined by the portion of the toroidal outer surface that intersects with the spherical surface of the golf ball, wherein the toroid is selected from the group consisting of rectangular toroids, elliptical toroids, and rectangular twisted toroids, wherein the toroid intersects the spherical surface of the golf ball in an orientation where the rotational axis of the toroid is parallel to a tangent of the spherical surface of the golf ball, wherein the rotational axis of the toroid does not intersect with the surface of the golf ball, and wherein the intersection of the toroid with the spherical surface of the golf ball results in two points of intersection between the toroidal outer surface and the spherical outer surface in the plane containing the maximum outer diameter of the toroid, and wherein the distance, $L_T$, between the two points of intersection is from 0.050 inches to 0.400 inches.

* * * * *